United States Patent [19]

Jardinier et al.

[11] Patent Number: 4,515,308

[45] Date of Patent: May 7, 1985

[54] FLOW STABILIZER FOR A VENTILATION DUCT

[75] Inventors: Pierre Jardinier, Gournay; Jack Simonnot, Ozoire la Ferriere, both of France

[73] Assignee: Societe d'Etudes et de Recherches de Ventilation et d'Aerauliques, Gournay, France

[21] Appl. No.: 462,951

[22] Filed: Feb. 1, 1983

[30] Foreign Application Priority Data

Feb. 5, 1982 [FR] France ..... 82 01903

[51] Int. Cl.[3] ..... F24F 13/08

[52] U.S. Cl. ..... 236/49; 236/44 A; 236/80 R; 251/61.1; 138/45

[58] Field of Search ..... 236/49, 44 R, 44 A, 236/80 R, 80 F; 251/61.1, 24; 138/45, 93

[56] References Cited

U.S. PATENT DOCUMENTS

| | | | |
|---|---|---|---|
| 2,514,040 | 7/1950 | Eksergian | 138/93 X |
| 3,809,314 | 5/1974 | Engelke | 236/49 |
| 3,817,452 | 6/1974 | Dean, Jr. | 236/49 |
| 3,840,177 | 10/1974 | Osheroff | 236/49 |
| 4,017,025 | 4/1977 | Dravnieks et al. | 236/49 |
| 4,186,876 | 2/1980 | Clark et al. | 236/49 |
| 4,251,027 | 2/1981 | Dehart et al. | 236/49 |
| 4,312,475 | 1/1982 | Edwards et al. | 236/49 |
| 4,356,953 | 11/1982 | Edwards et al. | 236/49 |

FOREIGN PATENT DOCUMENTS

| | | |
|---|---|---|
| 2251358 | 4/1973 | Fed. Rep. of Germany . |
| 2513600 | 10/1976 | Fed. Rep. of Germany . |
| 1339258 | 11/1962 | France . |
| 2259324 | 1/1975 | France . |
| 2411370 | 12/1978 | France . |
| 2466715 | 10/1979 | France . |

*Primary Examiner*—William E. Tapolcai

[57] ABSTRACT

A stabilizer for a ventilation duct includes a sensor, sensitive to a variable parameter such as temperature, which affects the flow of air in the duct. The sensor includes an opening in a return flow conduit communicating with a deformable chamber contained within a section of the duct. As the parameter changes, pressure at the opening changes thereby affecting the volume of the chamber and likewise the volume of the section of the duct in which the chamber is located.

7 Claims, 4 Drawing Figures

FLOW STABILIZER FOR A VENTILATION DUCT

BACKGROUND OF THE INVENTION

This invention relates to an improvement in a flow stabilizer for a ventilation duct.

Prior flow stabilizers, as exemplified by French Pat. No. 70 12 065, comprised a chamber consisting of a deformable bag, a seat supporting the chamber with a hole permitting air to enter or exit from the chamber, and means adapting the seat to the ventilation duct, so that the orifice is directed upstream. The respective dimensions of the chamber and the section of the duct were such that under the action of pressure differences existing upstream and downstream, the variation of volume of the chamber which resulted therefrom modified the section for the passage of air in the space made between the chamber and the duct. These devices had been designed to stabilize the air flow without amplifying its sudden fluctuations, and consequently without maintaining fluctuating operating conditions in the duct.

Although the bag constituting the chamber was made of an elastic and flexible material, because of the loss of elasticity of this material due to its aging, this stabilizer, was only slightly durable.

To eliminate this drawback, flow stabilizers were developed as shown in French Pat. No. 79 24 829, having elastic means associated with the bag chamber so that the elastic means was housed inside the chamber to provide its return to a minimum volume when the pressure difference between the ventilation duct areas located upstream and downstream from the chamber fell below a predetermined threshold.

Thus, the bag could be formed by molding it in the shape corresponding to its maximum volume, which, with the absence of undercut, facilitated its removal from the mold, and its return to its minimum value was no longer dependent upon its own elasticity. Its life was therefore considerably increased.

SUMMARY OF THE PRESENT INVENTION

The object of this invention is to provide a stabilizer of the type described above which is sensitive to the measured values of a variable parameter and capable of operating when the pressures in the ventilation ducts are very slight, which is the case in air conditioning units.

Accordingly, in the stabilizer of the present invention, the intake and outlet opening of the deformable chamber is connected by an auxiliary pipe to a pressure sensor associated with means for amplifying the effect of the dynamic pressure of the stream of air as well as with means sensitive to the variations of the parameter chosen, other than the pressure, and acting on the sensor to modify its action on the deformable chamber as a function of said variations of this parameter, at least when its value exceeds the limits of a predetermined range.

Consequently, the flow controlled by this stabilizer varies as a function of the variations of the parameter chosen.

According to a first embodiment of this stabilizer, the body of the device exhibits an auxiliary Venturi-shaped duct, constituting means for amplifying the effect of the dynamic pressure of the stream of air, whose intake and outlet are located, respectively, upstream and downstream from the deformable chamber. In the neck of the chamber, the auxiliary pipe emerges through an orifice constituting the pressure sensor, and a cavity is provided in the wall of the chamber upstream from the opening of said pipe. The cavity houses a valve movable crosswise to the duct, and includes a stem joined to a movement amplifying lever, itself joined to the means sensitive to the variations of the parameter chosen, and associated with elastic means, so as to control the retraction of the valve in its housing if the value of the parameter chosen exceeds a predetermined threshold and vice versa.

If, for example, the parameter chosen is the rate of humidity in the air, the means sensitive to the variations of this rate comprise the hair of an hygrometer subjected to the action of the air that circulates in the duct, and a small rod articulated on the lever rests, by its free end, on the hair of the hygrometer so as to cause the lever to pivot in the direction corresponding to the output of the valve when the hair becomes taut because of the reduction of the rate of humidity.

It is easily understood that the output of the valve resulting from the reduction of the rate of humidity in the air causes an increase of the pressure in the part of the main duct located upstream from this valve and, consequently, an inflation of the deformable chamber and a reduction of the stabilized flow.

According to a variant embodiment of the invention, the pressure sensor comprises a radial opening made in one of the ends of a cylindrical tube mounted in the body of the stabilizer so that this end projects into a part of the main duct located upstream of or at, the deformable chamber. The inner chamber is connected, through an airtight connection, with the auxiliary pipe, and the means sensitive to the variations of the parameter chosen is designed to modify the position of the radial opening in the main duct as a function of the variations and thus to amplify the effect of the dynamic pressure on it of the stream of air circulating in the main duct.

By modifying the position of the pressure sensor in the stream of air, the angle of incidence of the dynamic pressure of this stream of air on the operation of the stabilizer is modified. For example, the radial opening constituting the sensor can be oriented perpendicular to the flow of the stream of air and the modification of its position consists in a crosswise movement of the cylindrical tube in which said radial opening is disposed between two end positions, of which one corresponds to a maximum partial vacuum at the sensor and, consequently to a minimum volume of the chamber and a maximum air flow located at the deformable chamber, and the other of which corresponds to a minimum partial vacuum at the sensor and, consequently, to a maximum volume of the chamber and a minimum air flow located upstream from the deformable chamber.

Thus, for the same air flow, inflation of the deformable chamber increases and the stabilized flow decreases when the sensor is moved upstream, i.e., is moved away from the deformable chamber.

According to another particular embodiment of the stabilizer, the cylindrical tube is mounted in the body, so that the end including the radial opening constituting the pressure sensor is located at the deformable chamber, i.e., in the area of the smaller section of the main duct. Consequently, the greatest speed of the stream of air occurs at the sensor. The sensor is supported to pivot about its longitudinal axis and a control shaft extension, provided on the end opposite the end having the radial opening, is coupled to the means sensitive to the variations of the parameter chosen and associated with elastic means. The sensor is caused to pivot between a position in which said radial opening is oriented in the direction from which the stream of air circulating through the main duct comes (corresponding to maximum inflation of the deformable chamber) to a position in which the radial opening is oriented perpendicular to the direction of flow of the stream of air (corresponding to a maximum deflation of the deformable chamber) when the value of the parameter chosen increases. The airtight connection between the inner chamber of the revolving tube and the auxiliary pipe is provided by a revolving joint.

It is easily seen that, when the radial opening constituting the pressure sensor is oriented perpendicular to the direction of flow of the stream of air, the inner chamber of the revolving tube, and consequently, the deformable chamber are subjected to a partial vacuum arising from flow of the stream of air tangentially to said radial opening.

If, for example, the parameter chosen is the temperature, the means sensitive to its variations and the elastic means which are associated with them comprise a helical bimetallic strip one end of which being fastened to the body of the stabilizer and the other end being secured to the shaft extension that extends from one of the ends of the sensor.

BRIEF DESCRIPTION OF THE DRAWINGS

In any case, description of the invention that follows will be better understood with reference to the accompanying diagrammatic drawing, that represents, by way of nonlimiting example, two embodiments of this stabilizer, in which.

DETAILED DESCRIPTION OF THE INVENTION

Figure 1:
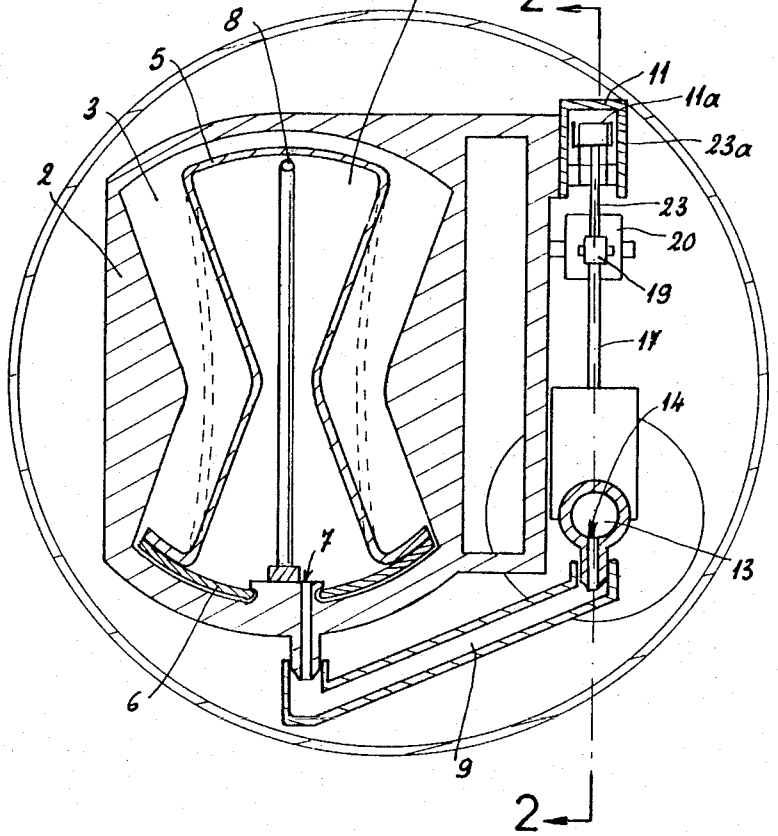
FIG. 1 is a sectional view of a first embodiment of the invention taken along line 1—1 of FIG. 2.

The two embodiments illustrated in the drawings are stabilizers of known types comprising a body 2 that can be adapted to a ventilation duct not shown in the drawing and in which is housed at least a main duct 3, a chamber 4 comprising a deformable bag 5 located in main duct 3, a seat 6 supporting the bag 5, with a hole made in small section 7 that allows the air to enter and exit from chamber 4 and recess or shoulder means that make it possible to adapt the seat 6 to body 2 of the apparatus. The respective dimensions of chamber 4 and crosswise sections of main duct 3 are such that under the action of the pressure differences existing upstream and downstream from bag 5, the variations of volumes of chamber 4 which results from it modify the section for passage of the air in space made between the wall of chamber 4 and the walls of main duct 3.

A spring 8 held by seat 6 may be associated with bag 5 to return chamber 4 normally to a position of minimum volume.

This known stabilizer, therefore, has as its function the stabilization of air flow in the ventilation duct independently of the variations of the difference of pressures existing upstream and downstream from the apparatus.

The object of this invention is to make possible an automatic adaptation of the adjustment of this stabilized flow as a function of the variations of a parameter other than pressure, and especially, under temperature or air humidity conditions over determined ranges of these parameters, even if the pressures brought into play are very slight, as is the case in air conditioning units.

To effect this purpose, the intake and outlet opening 7 of chamber 4 is connected by an auxiliary pipe 9 to a pressure sensor associated with means sensitive to the variations of the parameter chosen and to act upon it to modify its action on chamber 4 as a function of the variations of this parameter, at least when its value exceeds the limits of a predetermined range, and to amplify the effect of the dynamic pressure of the stream of air on the pressure sensor.

Figure 2:
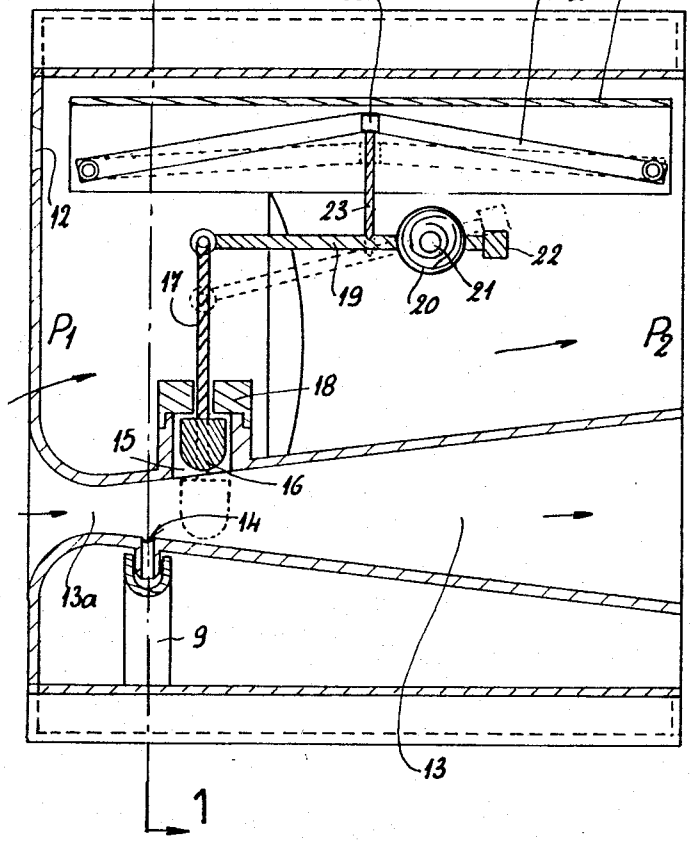
FIG. 2 is a sectional view of the stabilizer of FIG. 1 taken along section line 2—2 of FIG. 1.

In the example illustrated in FIGS. 1 and 2, the parameter chosen is the hygrometry rate of the air circulating in the ventilation duct and the means sensitive to the variations of this parameter comprise hair 11*a* of the hygrometer 11 held by body 2 of the apparatus so that hair 11*a* is exposed to, and is licked by the air flow that circulates in the ventilation duct. For this purpose, the wall upstream from body 2 includes an opening 12 that allows the entrance of an air flow that licks hair 11*a* all along its length.

In this example, body 2 exhibits an auxiliary Venturi-shaped conduit 13 which comprises the means for amplifying the effect of the dynamic pressure of the stream of air on the pressure sensor. The intake and outlet of this auxiliary duct 13 are located, respectively, upstream and downstream from deformable chamber 4. Auxiliary pipe 9 connecting input and output opening 7 of chamber 4 to the pressure sensor connects with auxiliary duct 13 at its neck 13*a* at opening 14 that constitutes the pressure sensor.

In the wall of auxiliary duct 13 downstream from neck 13*a* and, consequently, from opening 14 of auxiliary pipe 9, a cavity 15 is provided which houses a valve 16 movable crosswise to auxiliary conduit 13 between two positions; a first for retraction (represented by the solid lines in FIG. 2) and a second for total output (represented by dotted lines in the same figure). In the second position, the valve 16 almost totally obstructs auxiliary conduit 13.

The valve 16 is carried by a rod 17 that slides axially in a bearing 18 and includes a free end connected to one of the ends of a lever 19. The lever 19 is pivotably carried by a transverse horizontal shaft 21 supported on body 2 of the apparatus and is balanced by a counterweight 22. A small rod 23 is connected at one of its ends to lever 19 at a point located between rod 17 and the connection shaft 21. The other end 23*a* of rod 23 has the shape of a fork and bears against hair 11*a* of hygrometer 11, perpendicular to the latter. A spiral spring 20 is mounted about shaft 21, and has one end connected to lever 19 and its other end connected to shaft 21. Spring 20 normally biases forked end 23*a* of small rod 23 against hair 11*a* of hygrometer 11.

Hair 11*a* of hygrometer 11 is normally made of polyamide, and the change of its length is dependent on the relative humidity of the air. Spring 20, therefore, provides the maintenance of tension of hair 11*a*.

The operating principle of this stabilizer is as follows:

Under ordinary conditions of use corresponding to relative humidities between 30 and 70%, the length of hair 11*a* is such that valve 16 assumes a position where it partially blocks auxiliary conduit 13. This position is an intermediate position between those solid, and dotted line positions represented in FIG. 2.

When the relative humidity of the air decreases, the length of hair 11*a* decreases, which causes a downward movement of small rod 23 and, consequently, an amplified pivoted movement of the end of lever 19 connected to rod 17 and a corresponding downward movement of valve 16 in the direction of its maximum blocking position. Therefore, valve 16 tends to obstruct auxiliary conduit 13 even more. When the relative humidity of the air increases, the movements of valve 16 and of the elements which control it are obviously reversed.

The deformation of bag 5 depends on the pressures that are exerted on the outer faces of its walls and on the pressure imposed on its inside by pressure sensor 14 and auxiliary pipe 9. The difference between the pressure $P_2$ that prevails downstream from the stabilizer and that of the pressure Pv imposed on the inside of bag 5 (i.e., $Pv-P_2$) is equal to k $(P_1-P_2)$, a formula in which $P_1$ is the pressure that prevails upstream from the stabilizer, and k coefficient dependent on the position of valve 16 with respect to auxiliary duct 13 and, consequently, on the relative humidity of the air.

For relative humidity between 30 and 70%, valve 16 partially obstructs auxiliary duct 13, and Pv therefore takes a middle value between $P_1$ and $P_2$, k being positive and less than 1. The value of k decreases when the relative humidity increases.

The pressures to which the lateral walls and the posterior face of bag 5 are subjected, from the outside, are approximately equal to $P_2$; thus over the range of value between 30% and 70% of the rate of relative humidity of the air, the differences between the pressures exerted on the inside and the outside have a tendency to inflate bag 5. For a determined relative humidity between 30% and 70%, when the drive pressure of the air $P_1-P_2$ increases, $Pv-P_2$ increases, the bag is inflated and the passage for the air decreases so as to maintain the air flow at a value nearly independent of the drive pressure.

The value of the flow thus stabilized depends on the value of k, and on the rate of relative humidity; the greater this value the greater the relative humidity.

For very high relative humidities, for example 90%, (temporary conditions corresponding, for example, to the use of a shower or bath) valve 6 totally retracts in its housing 15. The Venturi-shaped auxiliary duct 13 is no longer disturbed by the presence of valve 16 and the static pressure at neck 13*a* and, consequently, of pressure sensor 14 decreases considerably to reach values lower than the pressure $P_2$ that prevail downstream. Coefficient k is then negative, and the volume of bag 5 decreases and becomes smaller than its volume at rest. The air flow in the ventilation duct is increased considerably, and is no longer stabilized. In this case, however, the desired goal is reached, since the operation of this stabilizer aims at very rapidly reestablishing the normal ambient conditions.

Figure 3:
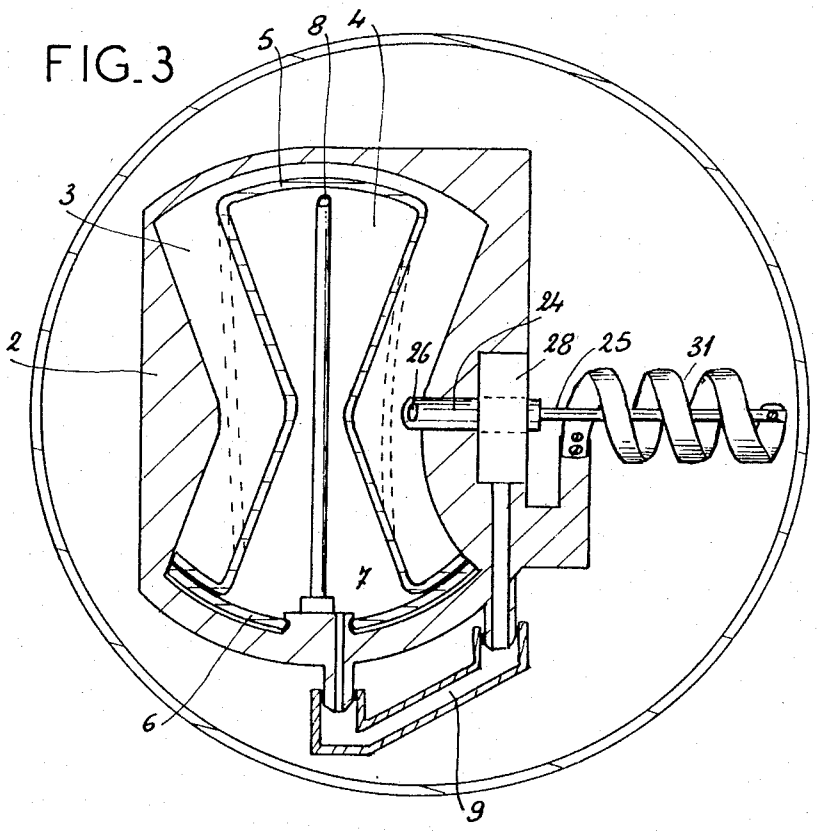
FIG. 3 is a view in section similar to that of FIG. 1 showing a second embodiment of the stabilizer.
Figure 4:
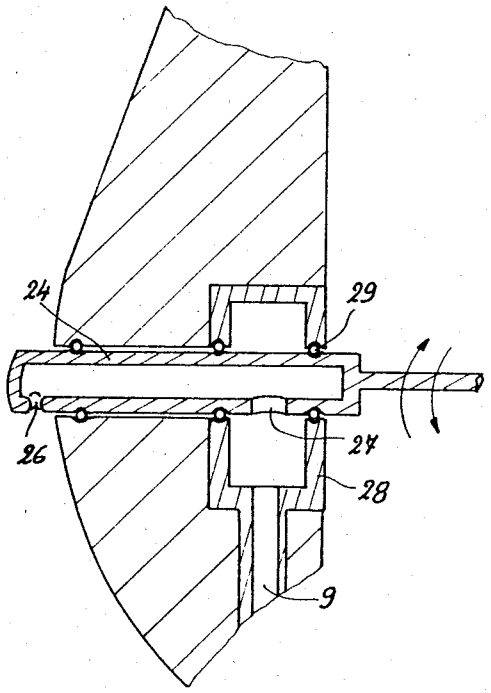
FIG. 4 shows, on a larger scale, a detail of FIG. 3.

In the embodiment of this stabilizer illustrated by FIGS. 3 and 4, the parameter chosen is the temperature.

In FIGS. 3 and 4, the elements identical with those of the embodiment illustrated by FIGS. 1 and 2 are designated by the same references, and are not described again.

In this second embodiment, a cylindrical tube 24 is mounted to pivot around its longitudinal axis in a bearing made in the body 2 of the apparatus, and one of its ends projects into the space made between the chamber 4 and the lateral wall of the main duct 3, i.e., into the area of the smallest section of the main duct 3 and of the greatest speed of the stream of air. The other end of tube 24 is extended by a shaft 25 located outside body 2.

Tube 24, which is closed at both its ends by diametrical walls, exhibits at its end projecting into the main duct 3 a radial opening 26 that constitutes the pressure sensor and, in the vicinity of the other end, a radial opening 27 that communicates by a revolving joint 28 with the auxiliary pipe 9. Ring seals 29 provide the tightness between the tube 24, the body 2 of the apparatus and the revolving joint 28. A bimetallic strip 31 is helically wound on the shaft 25 that extends the tube 24, one of the ends of this bimetallic strip 31 being fastened to the body 2 while its other end is fixed on the shaft 25.

The flow stabilizer regulated as a function of the temperature is particularly intended for the removal of the gases burned by home gas furnaces. When the furnace is operating, the flow of evacuated fumes must increase, which involves a decrease in the volume of the deformable chamber 4 when the temperature increases.

The operation of this stabilizer sensitive to the variations of temperature is, therefore, as follows:

When the temperature is low, pressure valve opening 26 is directed toward the air flow that circulates in the ducting, i.e., in the main duct 3, as illustrated in FIG. 3. Pressure sensor 26, therefore, receives a maximum pressure that it transmits through tube 24, opening 27, and auxillary pipe 9 to the inside of chamber 4. The volume of the chamber reaches its maximum possible value with a determined driving pressure $P_1-P_2$. The flow is stabilized at a low value when $P_1-P_2$ varies.

When the temperature of the air rises, bimetallic strip 31 causes shaft 25 and tube 24 to rotate, which tends to rotate orifice 26 out of the air flow, in such a way that the air intake is subjected to a lesser pressure. For a determined pressure $P_1-P_2$, the volume of chamber 4 decreases and the passage for the gases increases. The flow that goes through main duct 3 of the stabilizer is, therefore, stabilized at a higher value. At the limit, the stream of air tangentially licks opening 26, creating a partial vacuum which forces bag 5 to be deflated, and thus sensor 26 amplifies the effect of the dynamic pressure of the stream of air on sensor 26.

It goes without saying that the invention is not limited only to the embodiments of this stabilizer which have been described above, by way of nonlimiting example. On the contrary, it includes all the variant embodiments. Thus, for example, in the embodiment illustrated by FIGS. 1 and 2, the stabilizer could be associated with means sensitive to temperature, while, inversely, in the embodiment illustrated by FIGS. 3 and 4, it could be associated with means sensitive to the relative humidity of the air.

I claim:

1. A flow stabilizer for a ventilation duct, of the type comprising a body mountable in the duct, having at least a main duct, a chamber including therein a deformable bag in the main duct and a spring associated with the bag to nomally maintain the chamber in a state of minimum volume, a seat supporting the chamber and having an opening for entrance and exit of air into and out of the chamber, and means for fitting the seat to the body, the respective dimensions of the chamber and of the crosswise sections of the main duct being such that, under the action of pressure differences existing upstream and downstream, the variations of volume of the chamber which result therefrom modify the section for passage of the air in the space made between the walls of the chamber and those of the main duct, the improvement comprising:

a pressure sensor exposed to the flow of air in said main duct;

said opening for the chamber being interconnected by auxiliary pipe means to said pressure sensor, said pressure sensor including means for amplifying dynamic pressure resulting from the flow of air, means, sensitive to the variations of a predetermined parameter other than pressure, for affecting at least one of the amplifying means or the position of the sensor, and means, positioned downstream of said pressure sensor and coupled to said affecting means, for modifying volume of the deformable bag and hence the flow rate through the main duct of said body.

2. A flow stabilizer as in claim 1, wherein said amplifying means comprises a Venturi-shaped duct having a neck portion, an inlet and an outlet, the inlet and outlet being located respectively, upstream and downstream from the deformable chamber, said auxiliary pipe means communicating with said neck portion through the wall of said neck portion downstream therefrom, said neck portion including cavity means housing said modifying means, said modifying means comprising a valve movable across the diameter of the neck portion to a blocking position, and including a stem extending therefrom, said amplifying means further comprising a lever means coupling said stem with said affecting means and said elastic means for controlling movement of the valve relative to its housing when the value of the chosen parameter exceeds a predetermined threshold.

3. A flow stabilizer as in claim 2, wherein said chosen parameter is the humidity in the air, and said affecting means comprises stretchable hair means of hygrometer subjected to the action of the air circulating in the duct, and a small rod connected to the lever means and having one end bearing against said hair means causing said lever means to move said valve toward its blocking position when the hair means is stretched following the decrease in the rate of humidity.

4. A flow stabilizer as in claim 1, wherein said pressure sensor comprises a cylindrical tube mounted inside said body, said tube including at one end thereof a radial aperture, said one end projecting into said main duct at a location near said deformable chamber, and said tube inner chamber communicating through an airtight connection with said auxiliary pipe means, whereby said affecting means is arranged to modify the position of said radial aperture in the main conduit as a function of said variations, and thus to amplify the effect of the dynamic pressure of the stream of air circulating in the main duct.

5. A flow stabilizer as in claim 4, wherein said radial aperture is disposable perpendicular to the air flow, and the end of said cylindrical tube is supported for movement between an advanced position located upstream from said deformable chamber and corresponding to a minimum partial vacuum, and a retracted position located at the deformable chamber and corresponding to a maximum partial vacuum in the deformable chamber.

6. A flow stabilizer as in claim 4, wherein said cylindrical tube is mounted in said body with said radial aperture located at said deformable chamber, said tube being supported for rotation about its longitudinal axis, and having its other end connected with an extension shaft, the latter being coupled to said affecting means and said elastic means so as to cause said tube to rotate between a position in which said radial aperture faces the direction of air flow in the main duct, corresponding to a maximum inflation of the deformable chamber, to a position in which said aperture is directed perpendicular to said direction of air flow, corresponding to a maximum deflation of the inflatable chamber when the value of the chosen parameter increases, the air tight connection between the interior chamber of said tube and said auxiliary pipe being provided by a rotating joint.

7. A flow stabilizer according to claim 6, wherein said chosen parameter is temperature, and said affecting means and said elastic means comprise a helical bimetallic strip having one end fastened to said body and the other end secured to said extension.

* * * * *